United States Patent [19]

Yashima

[11] 4,155,673

[45] May 22, 1979

[54] FLOATING STRUCTURE

[75] Inventor: Nobuyoshi Yashima, Funabashi, Japan

[73] Assignee: Mitsui Engineering & Shipbuilding Co. Ltd., Tokyo, Japan

[21] Appl. No.: 800,929

[22] Filed: May 26, 1977

[51] Int. Cl.[2] ..... E02D 21/00; B63B 35/00

[52] U.S. Cl. ..... 405/224; 114/256; 114/293

[58] Field of Search ..... 61/98, 86, 87, 93, 94; 114/256, 264, 265, 293; 175/7, 9

[56] References Cited

U.S. PATENT DOCUMENTS

| | | | |
|---|---|---|---|
| 3,086,368 | 4/1963 | Popper | 61/86 |
| 3,191,696 | 6/1965 | Pollard et al. | 175/7 |
| 3,459,270 | 8/1969 | Schuh | 175/7 |
| 3,605,413 | 9/1971 | Morgan | 114/264 |
| 3,620,181 | 11/1971 | Naczkowski | 114/293 |
| 3,973,635 | 8/1976 | Gatlin | 175/7 |
| 3,996,755 | 12/1976 | Kalinowski | 61/86 |
| 4,020,779 | 5/1977 | Kitt | 114/293 |

FOREIGN PATENT DOCUMENTS

| | | | |
|---|---|---|---|
| 689,872 | 6/1964 | Canada | 61/94 |

OTHER PUBLICATIONS

Ocean Industry, Mar. 1976, pp. 67–69.

*Primary Examiner*—Jacob Shapiro
*Attorney, Agent, or Firm*—Armstrong, Nikaido, Marmelstein & Kubovcik

[57] ABSTRACT

The invention relates to a floating structure, e.g. an offshore platform adapted for use in exploitation of submerged oil fields and the like purposes at offshore areas. The structure has a platform from which extended downwardly are columns carried by footings having buoyancy large enough to keep the platform afloat. Tension wires are extended through the footings for connection to the sea bottom in a diverging manner. Sinkers are provided at intermediate portions of respective tension wires so that the portions of the laters between the sea bottom and the points at which the sinkers are provided may exhibit sags. The sagged portions of the tension wires are expected to present a buffering effect to diminish the extraordinary large tension in the tension wires attributable to the movement of the platform. The up and downward movement of the platform is prevented by a riser pipe extended from the center of the platform. The riser pipe is prevented from being buckled by a provision of a buoyancy body attached thereto.

4 Claims, 5 Drawing Figures

FLOATING STRUCTURE

BACKGROUND OF THE INVENTION

Offshore platforms or floating structures have been widely used as bases for exploitation of submarine oil field and undersea mineral resources.

There are two types of floating structures: one is the fixed type having a platform on supporting legs driven into the sea bottom, while the other is so-called tension leg type in which a platform having buoyancy is moored at a constant sea area by means of anchor ropes.

However, the fixed type floating structure is short for modern exploitation at deep sea areas, because it necessitates a large supporting structure, and the tension leg type structure is being moved into limelight.

FIG. 1 shows a construction of typical conventional tension leg type floating structure.

A working platform 1 is supported by a plurality of columns having buoyancy. Trusses 3 are provided between the columns and between the platform and columns, for tightly fastening them one another. The columns are connected to anchors 5 rigidly fixed to the sea bottom, through tension wires 4, so that the platform and the columns are maintained in half-submerged state against the buoyancy. In this type of structure, however, excessively large force is applied to each tension wire 4, when the platform rolls and pitches, presenting a fear of breakdown of the tension wires 4 which may result in downfall of the platform.

In addition, it is quite difficult to maintain the constant point at which the floating structure is to be moored, against horizontal forces applied thereto, e.g. forces by the tide, wave and wind.

In order to overcome these problems, a structure as shown in FIG. 2 has been proposed, in which a platform 1 and a bottle hull 7 having a large buoyancy are connected by means of columns 6 of small diameter and trusses 3. The structure is installed in such a manner tension wires 8 are stretched between the bottle hull 7 and sea-bottom anchors 5 in a diverging manner so as to maintain the bottle hull in the submerged state. This arrangement is effective to restrain the lateral displacement of the structure such as horizontal movement or rotation, and the influence of the wind and wave is diminished due to the reduced diameter of the columns 6.

However, even this improvement arrangement could not avoid the fear of breakage of the tension wires 8 which are always in tightened condition, due to an extraordinary force which may be applied to the platform 1, thus holding the possibility of danger of downfall of the platform.

SUMMARY OF THE INVENTION

Under these circumstances, the present invention is to overcome above stated problems inherent in the conventional floating structure of tension leg type adapted to be used at deep sea area.

It is therefore an object of the invention to provide an offshore platform having a good and improved stability.

It is another object of the invention to provide a floating structure in which tension wires for mooring the structure are kept in a sagged state, so that a slight movement of the platform may not cause excessively large tensile force in the tension wires.

It is still another object of the invention to provide a floating structure in which the rotation and swinging, as well as movement up and down, are restrained.

To these ends, according to the invention, there is provided a floating structure in which columns are suspended from a platform. Footings having a large buoyancy are provided on the columns to impart a buoyancy to the platform. Tension wires are provided between the columns and the sea bottom in a diverging manner, with sinkers suspended from the intermediate portions thereof. A riser pipe is provided to extend from the center of the platform down to the sea bottom, with a buoyancy body attached to its intermediate portion so as to reduce the underwater weight of the riser pipe.

Due to the provision of footings having large buoyancy on the columns suspended from the platform, a sufficiently large buoyancy is imparted to the platform by the submerged footings.

The rotation and other horizontal movement of the platform are avoided by the plurality of tension wires provided between the lower ends of the columns and the sea bottom in a diverging manner, the tension wires being held in a sagged state by the sinkers attached thereto.

In addition, when the platform rolls and pitches in accordance with the force of wind and wave, the sagged tension wires are straightened to absorb the increased tensile force, acting as buffer means, so that the breakdown of the tension wires is fairly avoided.

The riser pipe connecting the platform and the sea bottom exhibits some flexibility, when the length thereof becomes large, and effective to prevent the platform from being moved up and down.

The buoyancy body attached to the intermediate portion of the riser pipe is effective to protect the top end portion of the riser pipe against a large tensile force, through diminishing the submerged weight of the riser pipe, thereby to avoid the breakage of the riser pipe.

These and other objects, as well as advantageous features of the invention will become clear from the following description of preferred embodiments of the invention taken in conjunction with the attached drawings in which:

DESCRIPTION OF THE PREFERRED EMBODIMENTS

Figure 3:
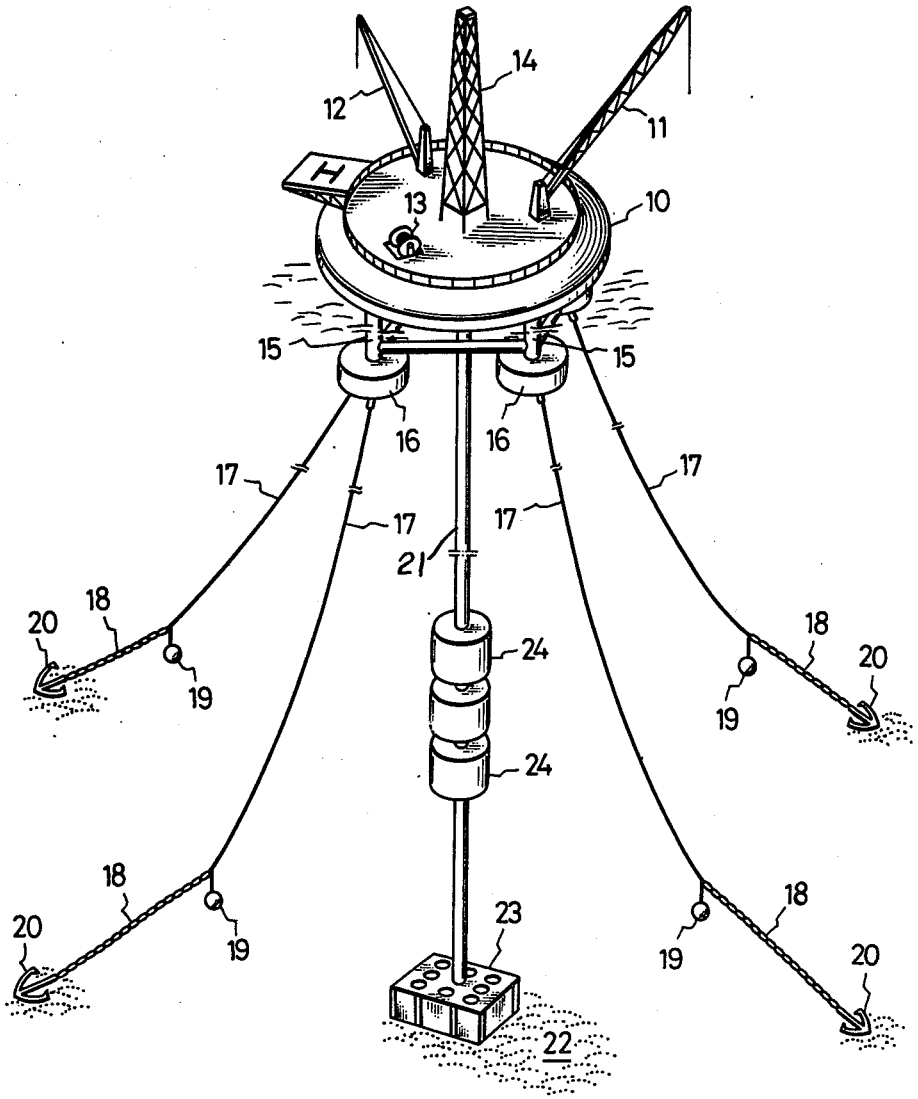
FIG. 3 is a perspective view of an offshore platform embodying the present invention.
Figure 4:
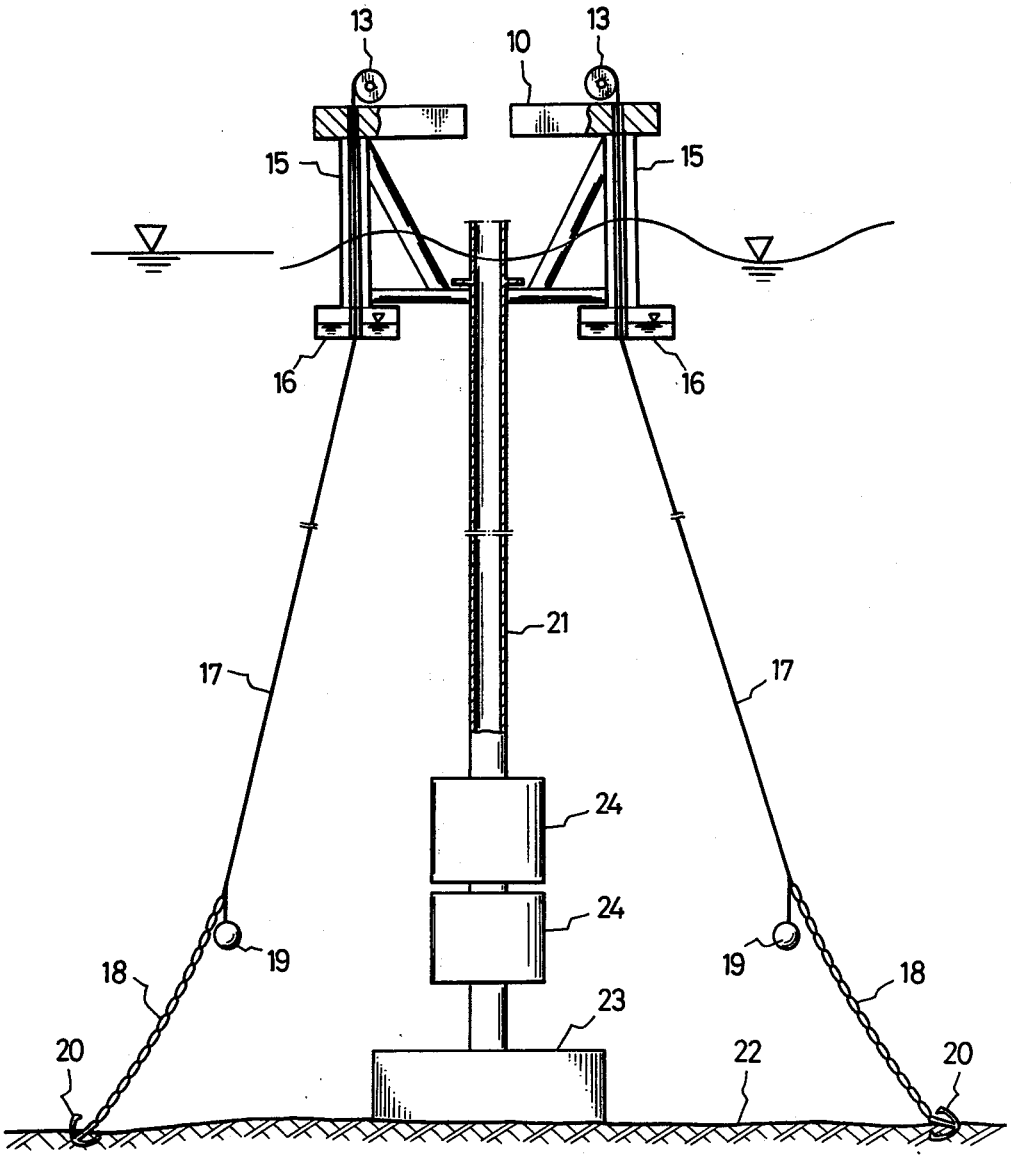
FIG. 4 is a side elevational sectional view showing the manner for supporting the platform by a riser pipe and tension wires.

Referring to FIGS. 3 and 4 showing an embodiment of the present invention, a platform generally denoted by 10 has a conical shape so as to withstand the wind. The platform 10 carries various equipments for use in loading and unloading of materials and other purposes, e.g. cranes 11, 12, winche 13 and a scaffold 14. Lodging facilities and other necessary equipments are provided inside of the platform 10.

Footings 16 having a large buoyancy, capable of functioning as ballast tanks, are attached to the lower end of the platform 10, through columns 15. The weight of the platform 10 is born by the buoyancy provided by the footings. Tension wires 17 are extended in a diverging manner, from the centers of lower ends of the hootings 16.

The lower ends of the tension wires 17 are connected to respective chains 18 which in turn are connected to anchors 20. To the joints of the tension wires 17 and the chains 18, secured are sinkers 19, so that each line constituted by the tension wire and the chain is sagged at the point of connection and the tension wire rises steeply toward the sea surface.

The tension wires go through respective central openings of the footings 16 and columns 15 to be wound around the drums of winches 13 provided on the platform 10. The tensile force applied to the tension wire can be adjusted by means of the winch 13, thereby to minimize the swinging of the floating structure.

A riser pipe 21, which can play also the role of a guide for a drill for well drill, is extended from the center of the platform 10. The lower end of this riser pipe is fixed to a sea-bottom base 23 secured to the sea bottom 22, which constitutes a dead-weight anchor, while the upper ends thereof is fixed to the platform 10. The platform 10 is kept afloat, with the footings 16 being submerged against their buoyancies by the tensile forces exerted through the tension wire and the riser pipe.

As the depth of the sea and, accordingly, the length of the riser pipe 21 becomes large, the weight of the riser pipe 21 becomes correspondingly large to pull the platform 10 downward to negate the buoyancies of the footings 16, so that the tension in the tension wire is decreased disadvantageously to below the predetermined one.

On the other hand, an advantage is provided that the weight of the sea-bottom base 23 in support of the riser pipe 21 can be made small.

However, when the length of the riser pipe 21 becomes large, it exhibits a flexibility rather than rigidity, so that it is preferable to take the riser pipe 21 as a wire, rather than a rigid pipe. The large flexibility of the long riser pipe 21 allows the latter to sag in accordance with the lateral and up and down movement of the platform, in combination with the increased weight of the riser pipe itself.

Once the riser pipe exhibits a sag, the increased weight of the pipe is concentrated to the sagging point to cause a larger sag and, in the worst case, the breakdown of the riser pipe due to buckling.

In order to avoid above stated buckling of the riser pipe 21 and the reduction of buoyancy of the footings 16, according to the invention, there is provided a buoyancy body 24 attached to an intermediate portion of the riser pipe 21 for carrying the weight of the latter.

Although only one riser pipe 21 is shown in the illustrated embodiment, the platform can have two or more riser pipes in accordance with the purpose and scale thereof.

A problem has been pointed out that the connection between the sea-bottom base 23 fixed to the sea bottom 22 and the riser pipe 21 is apt to be broken, because it is subjected to the maximum load and bending force. In order to avoid this breakage, a structure as shown in FIG. 5 is recommended for constituting the connection.

Figure 5:
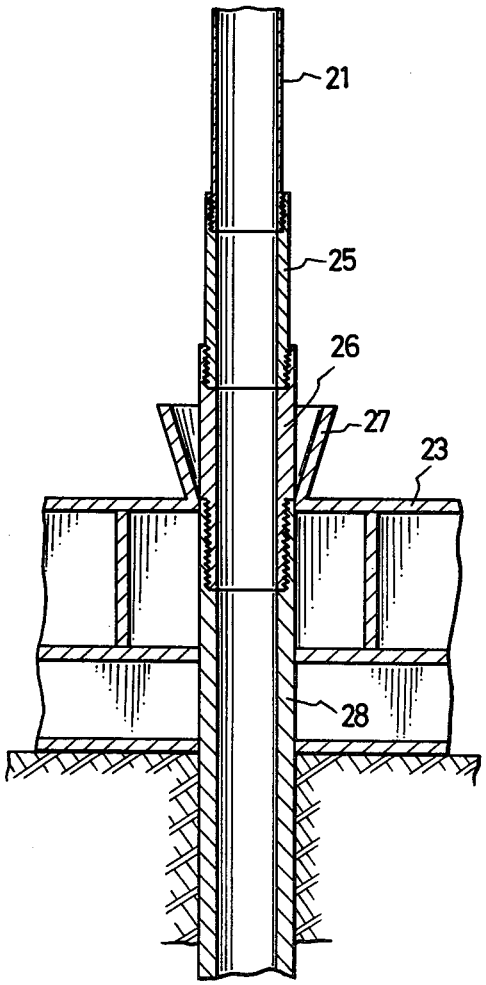
FIG. 5 is a side elevational sectional view of a connection structure between the riser pipe and a sea-bottom base.

More specifically, referring to FIG. 5, connecting pieces 25, 26 are connected in series to the lower ends of the riser pipe 21. The connecting pieces are prepared in parallel such that the one closer to the sea bottom has a larger thickness than that closer to the sea surface. The connection pieces arranged in series are allowed to get into the sea-bottom base 23, through a flared guide 27 formed therein, and is screwed onto a casing 28 which is driven into the sea bottom.

As stated above, the wall thickness of the pipe connection from the riser pipe 21 to the casing 28 is increased progressively or in a stepped manner, at a rate which is selected taking the weight of the riser pipe 21 and the bending moment.

Figure 1:
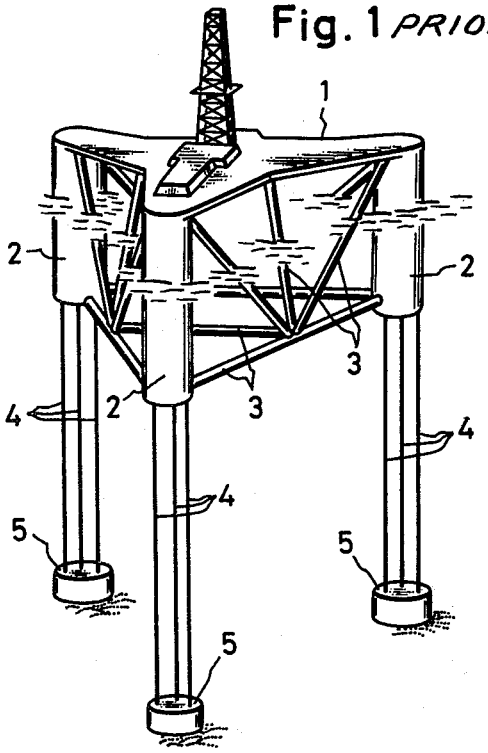
Fig. 1 PRIOR ART
FIG. 1 is a perspective view of a conventional offshore platform of tension leg type.
Figure 2:
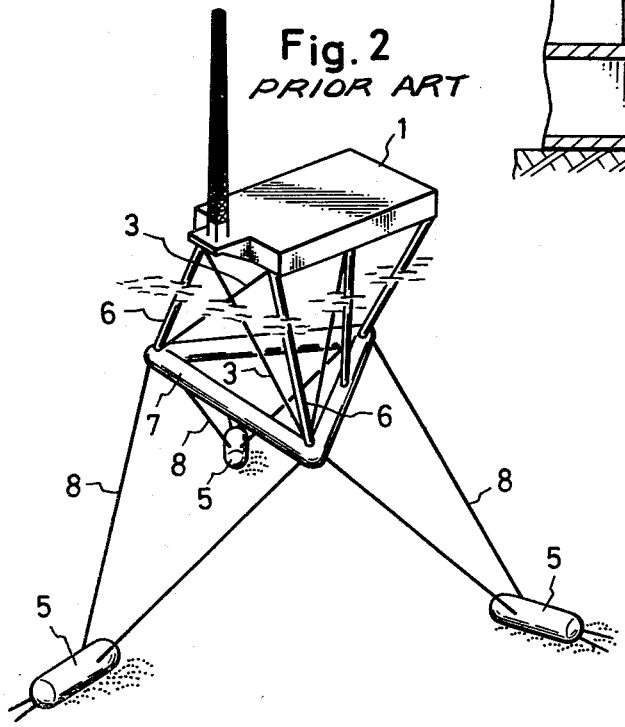
Fig. 2 PRIOR ART
FIG. 2 is a perspective view of a conventional offshore platform of tension leg type having columns extended downwardly from a platform and a bottle hull having a large buoyancy attached to the lower ends of the columns so as to increase the stability.

It will be seen that the floating structure in accordance with the invention is free from the problems as stated in connection with the conventional arrangement of FIGS. 1 and 2, and provided the following advantageous effects.

Firstly, thanks to an arrangement that the tension wires 17 being extended from the platform 10 in a diverging manner, the ends of the tension wires being fixed to respective anchors 20, with sinkers 19 attached to intermediate portions thereof, so as to allow a sag in chains 18 between the tension wires and the anchors 20 or in the portions of the tension wires between respective sinkers and the anchors, keeping the tension wires straightened between the sinkers and the platform 10, the platform 10 is prevented from being rotated and moved horizontally. At the same time, the chains 18 between the sinkers 19 and the anchors 20 or portions of the tension wires between the sinkers 19 and the anchors 20, which have been sagged, provide effective buffer to protect the straightened portions of the tension wires from an extraordinary large force caused by an up and down movement of the platform due to wind and wave.

Secondly, since the riser pipe 21 extended from the center of the platform 10 is used as a locating member, in combination with the tension wires, the up and downward movement of the platform 10 is prevented also by the riser pipe.

Thirdly, due to the provision of footings secured to the platform through columns, the footings having enough buoyancy to keep the platform afloat and to impart sufficient stabilizing force to the tension wires, the rolling and pitching of the platform are conveniently diminished.

Fourthly, the buoyancy body 24 attached to the riser pipe 21 connecting the platform 10 and the sea bottom 22 conveniently bears the weight of the riser pipe 21, so as to prevent the riser pipe 21 from being buckled and to protect the connection between the riser pipe 21 and the sea-bottom base 23 against the concentration of force due to the weight of the pipe 21.

In addition, since the apparent weight of the riser pipe 21 is decreased, the weight of the structure, e.g. the sea-bottom base, in support of one end of the pipe can be decreased, which contributes to facilitate the shifting of the berth of the floating structure as a whole.

As has been stated, the present invention is characterized by comprising footings for imparting a buoyancy to a platform, tension wires extended in a diverging manner and a riser pipe which in combination act to locate the footings, the tension wires having straightened portion and sagged portions, whereby the sagged portions present a buffering effect.

For forming the sag, sinkers are attached to the intermediate portions of the respective tension wires. Thus, the sinkers 19 are preferably kept away from the sea bottom, clearing the later.

The sinker 19 may be singular, or may be provided in plural. In the later case, it is preferable to arrange such that some of the sinkers are laid on the sea bottom, while the other being suspended from the tension wires.

For conveniently forming the sag, it is preferable to connect large masses having flexibility, such as chains as is in the described embodiment. However, it is possible to extend the tension wires to form the sagged portion in each of them.

The buoyancy body provided on the riser pipe may be secured directly to the intermediate portion of the riser pipe or may be fixed at a certain space therebetween. Alternatively, the buoyancy body may be connected to the riser pipe through a buoyancy body wire.

Having described the invention through a specific embodiment, it is to be pointed out that the described embodiment is not exclusive and various changes and modifications may be imparted thereto without departing from the scope of the technical idea of the present invention.

What is claimed is:

1. A floating structure comprising:

a platform;

columns extending downwardly from said platform;

buoyancy footings provided under said columns;

a plurality of tension wires, each said tension wire passing through a respective footing and having one end connected to a winch located on said platform and the other end connected to a respective anchor, said tension wires being disposed in a fan-like arrangement spreading out below said platform, said tension wires primarily suppressing rolling and pitching of said platform;

a plurality of sinkers, at least one sinker being suspended from an intermediate portion of each said tension wire, said tension wires being substantially straight or stretched at portions above said sinkers and sagged at portions below said sinkers, said sinkers being positioned such that at least one sinker on each tension wire intermediate portion is normally not in contact with the sea bottom;

a riser pipe means extending downwardly from the center of said platform and having a lower end connected to a sea-bottom base fixed to the sea bottom, said riser pipe means comprising a series of connecting pipes having wall thicknesses which decrease, as the riser pipe means gets closer to the sea surface, progressively or in a stepped manner, said riser pipe means preventing up and down movement of said platform;

buoyancy body means comprised of a plurality of buoyancy bodies provided at intermediate portions of said riser pipe means, said buoyancy bodies reducing the submerged weight and preventing buckling of said riser pipe means and reducing the tensile force applied on the top end portion of said riser pipe means;

said footings being moored in a submerged condition against their buoyancy by the action of said tension wires and said riser pipe means.

2. A floating platform as claimed in claim 1 wherein said sea-bottom base includes a flared guide for facilitating connection of said riser pipe to said sea-bottom base.

3. A floating platform as claimed in claim 2, wherein said sea-bottom base further includes a casing driven into the sea bottom for receiving said lower end of said riser pipe after said lower end passes through said flared guide.

4. A floating structure as claimed in claim 1, wherein said tension wires are extended in a diverging manner, being straightened or stretched at portions thereof above said sinkers and sagged at portions thereof below said sinkers, the sagged portions of said tension wires being constituted by respective chains.

* * * * *